US011911686B2

(12) United States Patent
Piumarta

(10) Patent No.: US 11,911,686 B2
(45) **Date of Patent: *Feb. 27, 2024**

(54) CAST IN SHAFT NUT FOR SKATEBOARD TRUCK

(71) Applicant: NHS, Inc., Santa Cruz, CA (US)

(72) Inventor: Timothy Charles Piumarta, Aptos, CA (US)

(73) Assignee: NHS, Inc., Santa Cruz, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/979,438

(22) Filed: Nov. 2, 2022

(65) Prior Publication Data

US 2023/0249051 A1 Aug. 10, 2023

Related U.S. Application Data

(63) Continuation of application No. 17/667,922, filed on Feb. 9, 2022, now Pat. No. 11,491,390.

(51) Int. Cl.
*A63C 17/01* (2006.01)

(52) U.S. Cl.
CPC ..... *A63C 17/012* (2013.01); *A63C 17/015* (2013.01)

(58) Field of Classification Search
CPC ..... A63C 17/012; A63C 17/015
See application file for complete search history.

(56) References Cited

U.S. PATENT DOCUMENTS 1,640,134 A 8/1927 Salberg
4,311,319 A 1/1982 Snyder et al.
4,398,734 A 8/1983 Barnard
4,443,022 A 4/1984 Ware
4,898,398 A 2/1990 Cassel
5,397,141 A 3/1995 Hoshizaki et al.
5,879,013 A 3/1999 Shih
6,070,886 A 6/2000 Cornelius et al.
6,182,987 B1 2/2001 Bryant
6,467,782 B1 10/2002 Smith
6,793,224 B2 9/2004 Stratton
6,932,362 B1 8/2005 Barrett
(Continued)

OTHER PUBLICATIONS

Grindking.com, "About", 2021, grindking.com/about-grindking/, retrieved on Jul. 26, 2021, 3 pages.
Youtube.com, "Grind King Disruptor Review!!!", uploaded Sep. 28, 2019, https://www.youtube.com/watch?v=77wjdaOYpOk, 4 pages.
Youtube.com, "Grind King Disruptor—First Look!", uploaded Apr. 5, 2019, https://www.youtube.com/watch?v=HsNfydyN3ew, 3 pages.
(Continued)

*Primary Examiner* — Bryan A Evans
(74) *Attorney, Agent, or Firm* — Dority & Manning, P.A.

(57) ABSTRACT

A skateboard truck includes a metal bolt called a kingpin and a threaded fastener, called a hex nut, which when combined hold the two main components of a truck together: the baseplate, which is mounted to the bottom surface of the skateboard deck; and the turning part of the truck called the hanger, which is mounted onto the baseplate by means of the kingpin, and affixed tightly into the baseplate by means of a threaded shaft nut assembly permanently affixed within the baseplate. Two bushings placed along the shaft of the kingpin and on either side of a flange protruding from the hanger hold the hanger in place by the tightening of the kingpin into the threaded shaft nut fastener. The kingpin is oriented such that a threaded portion of the kingpin (on an end opposite a bolt head portion) is generally facing towards a bottom surface of the skateboard deck.

17 Claims, 12 Drawing Sheets

(56) References Cited

U.S. PATENT DOCUMENTS

| | | | | |
|---|---|---|---|---|
| 7,104,558 | B1 | 9/2006 | Saldana | |
| 7,722,060 | B1 | 5/2010 | Clark | |
| 8,888,108 | B1 | 11/2014 | Beaty et al. | |
| 9,604,123 | B2 | 3/2017 | Tolman | |
| 11,224,793 | B1 | 1/2022 | Piumarta | |
| 11,491,390 | B1 * | 11/2022 | Piumarta | A63C 17/0093 |
| 2004/0145142 | A1 | 7/2004 | Wang | |
| 2004/0207169 | A1 | 10/2004 | Kent et al. | |
| 2004/0245738 | A1 | 12/2004 | Inchley | |
| 2006/0097470 | A1 | 5/2006 | Chmelar | |
| 2009/0079147 | A1 | 3/2009 | Conners et al. | |
| 2011/0236607 | A1 | 9/2011 | Woncik | |
| 2012/0104706 | A1 | 5/2012 | Wilson et al. | |
| 2013/0113170 | A1 | 5/2013 | Braden et al. | |
| 2013/0308887 | A1 | 11/2013 | Gesmer | |
| 2017/0087441 | A1 | 3/2017 | Ivazes | |
| 2017/0203193 | A1 | 7/2017 | Powell et al. | |
| 2018/0193721 | A1 | 7/2018 | Martinez Almansa et al. | |
| 2021/0052970 | A1 | 2/2021 | Tyler | |

OTHER PUBLICATIONS

Youtube.com, "Grind King Disruptor Update", uploaded Oct. 5, 2019, https://www.youtube.com/watch?v=YD9PL9hWPzM, uploaded on Oct. 5, 2019, 2 pages.

European Search Report for Application No. EP 21204570.2, dated Mar. 23, 2022, 7 pages.

1990 Advertisement for Gordon & Smith Trucks, 1 page.

USPTO Non-Final Office Action for U.S. Appl. No. 17/221,322, dated Jun. 15, 2021, 10 pages.

USPTO Notice of Allowance for U.S. Appl. No. 17/221,322, dated Sep. 15, 2021, 10 pages.

USPTO Non-Final Office Action for U.S. Appl. No. 17/158,393, dated Apr. 7, 2021, 13 pages.

USPTO Notice of Allowance for U.S. Appl. No. 17/158,393, dated Aug. 31, 2022, 10 pages.

Extended European Search Report for Application No. EP 23155787.7, dated Dec. 8, 2023. 8 pages.

* cited by examiner

CAST IN SHAFT NUT FOR SKATEBOARD TRUCK

PRIORITY CLAIM

The present application is a continuation of United. States Patent application Ser. No. 17/667,922 having a filing date of Feb. 9, 2022 which is incorporated herein by reference in its entirety.

FIELD

The present disclosure generally relates to skateboard trucks, and, more particularly, truck kingpins and fasteners that affix a turning axle to a mounting baseplate.

BACKGROUND

Skateboards have been a popular sporting good in which a user balances on a pivotable deck supported by wheels. One conventional design of a skateboard includes multiple components, including a skateboard deck, one or more skateboard trucks, one or more axels and/or wheels, and/or bearings. The skateboard deck is the platform upon which the user stands. The skateboard trucks are turning devices for the skateboard and additionally the carriers of the axles upon which wheels and bearings are placed. Each truck includes two wheels and four bearings mounted to the axle portion of the truck. The two turning trucks are mounted to the bottom surface of the skateboard deck. Finally, it is common to have mounted on the top surface of the skateboard an anti-skid or anti-slip tape, providing traction for the user as to not slip off the deck when riding the skateboard.

SUMMARY

Aspects and advantages of embodiments of the present disclosure will be set forth in part in the following description, or may be learned from the description, or may be learned through practice of the embodiments.

One example aspect of the present disclosure is directed to a skateboard truck that includes a baseplate, a hanger, shaft nut assembly permanently affixed to the baseplate, and a kingpin bolt. The baseplate is configured for mounting to a bottom surface of a skateboard deck. The hanger is configured to hold an axle. The shaft nut assembly can be permanently affixed inside the baseplate. For example, the kingpin bolt can have a threaded portion affixed to the shaft nut assembly to secure the baseplate and the hanger together. In some embodiments the baseplate can include a first and second opposing primary surface. For example, the primary surface can be configured to be coincident with a bottom surface of the skateboard deck. The primary surface of the baseplate can include a recessed cavity. The shaft nut assembly can be permanently affixed within the recessed cavity.

These and other features, aspects, and advantages of various embodiments of the present disclosure will become better understood with reference to the following description and appended claims. The accompanying drawings, which are incorporated in and constitute a part of this specification, illustrate example embodiments of the present disclosure and, together with the description, serve to explain the related principles.

BRIEF DESCRIPTION OF THE DRAWINGS

Detailed discussion of implementations directed to one of ordinary skill in the art is set forth in the specification, which refers to the appended figures, in which.

Figure 1A:
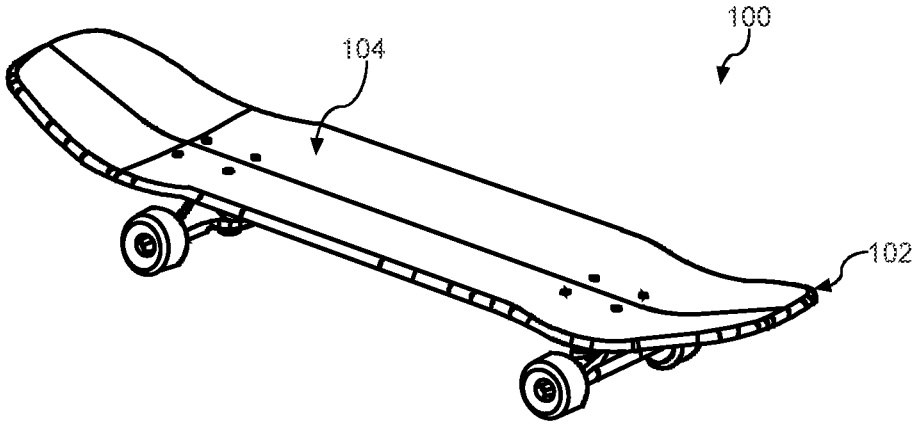
FIG. 1A provides a top perspective view of a skateboard according to example embodiments of the present disclosure.

Reference numerals that are repeated across plural figures are intended to identify the same features in various implementations.

DETAILED DESCRIPTION

Example aspects of the present disclosure are directed to improved skateboard trucks. One known configuration of a skateboard truck includes a metal alloy (e.g., aluminum) baseplate which mounts to the bottom surface of the skateboard using a multitude of steel machine screw fasteners and nylon insert locknuts. This known baseplate design can be rectangle, square, and/or oval in shape, with two major surfaces and can be made from aluminum metal, and can have a steel bolt pressed through a hole of the baseplate. The bolt can be oriented in such a fashion as to have the bolt head nested into a recess pocket on the major surface of the baseplate coincident to the bottom surface of the skateboard deck. The threaded portion of the bolt can be positioned protruding beyond the opposing major surface of the baseplate.

Conventional assembly of the hanger to the baseplate can include the following steps. A circular steel washer with a hole in its center is placed onto the exposed threaded shaft end of the kingpin. Next is placed a circular elastomeric bushing with a hole in the center. Next, the hanger's integral flange with circle receiver hole is fitted onto the kingpin. Next, a second circular elastomeric material bushing with a hole in its center is, placed onto the kingpin. Next is placed a circular steel washer with a hole in its center. Finally, a common nylon insert hex locknut is threaded onto the kingpin end. The kingpin threads are of sufficient length as to allow for tightening of the nut. It is this nut tightening action which affixes the hanger to the baseplate. The tightening action itself and the degree to which the nut is tightened can affect the ease of which the hanger may turn relative to the baseplate and fixed kingpin. It is desirable for skateboard trucks to have this feature of tightening the nut and thus controlling the amount of tension on the hanger and ease or difficulty of turning which makes for increased control of the skateboard.

One potential problem with the design of some known trucks is that the end of the threaded kingpin is fixed, in particular, a fixed distance relative to the bottom surface of the skateboard and also relative to the ground upon which the skateboard rolls. Tightening the nut to increase turning tension on the hanger does not change the fixed position of the end of the kingpin. Conversely, loosening the nut to decrease turning tension on the hanger also does not change the fixed position of the end of the kingpin relative to the ground surface upon which the skateboard rolls. The end of the kingpin protrudes from the baseplate and hanger, and is exposed in such a way that obstacles on the ground surface can and often do impact the end of the kingpin. This impact can completely stop or alter the momentum of the skateboard, with the result that the user is at an increased risk of falling off the skateboard, losing control of the skateboard, or otherwise having motion of the skateboard be affected from desired motion.

It would be more desirable to have a skateboard truck design such that when the user wishes to tighten the kingpin nut to beneficially affect the tension of the turning of the truck hanger, the end of the kingpin would recede into the baseplate and create more dimensional clearance between it and any obstacles on the ground. It is desired to provide skateboard trucks having such capability.

As such, example aspects of the present disclosure are directed to a skateboard truck where the orientation of the kingpin and fastening and/or tightening nut are inverted or reversed (e.g., relative to conventional skateboards). The tightening nut (e.g., shaft nut assembly) can be permanently affixed within a recess pocket on the major surface of the baseplate coincident to the bottom surface of the skateboard deck (e.g., as a step in the manufacturing, such as molding) The nut assembly can be permanently affixed within the baseplate dud rig a metal casting process, with aluminum surrounding an outer diameter annual surface of the shaft nut assembly. The shaft nut assembly can be placed within the cavity of the baseplate mold Molten aluminum can be introduced between the outer diameter annular surface of the nut assembly and the inner surface of the mold cavity in the baseplate. During this process pressure can be applied. The assembly steps and/or orientations of the steel washers, elastomeric cushions, flange of the hanger, etc. can be the same as a known truck configuration, with the exception that the kingpin bolt head can be positioned to be protruding beyond the opposing major surface of the baseplate.

The specialty shaft nut assembly can include a monocoque construction of a conventional nylon insert hex nut on one end, combined with an elongated hollow shaft, combined with an additional hex shape at the opposing end. The fastening/tightening nut can hereinafter be referred to as a "shaft nut assembly." This hex shape can be equal to the hex shape of the common nylon insert hex nut at one end, but with no threads nor nylon features. A hole can travel through the entirety of the shaft nut assembly. The shaft nut can be permanently affixed during an in-situ molding process. The permanently affixing of the shaft nut assembly (e.g., by an in-situ molding process, etc.) can prevent the shaft nut assembly from moving in any direction (e.g., radially relative to its major axis, linearly along its major axis, etc.). The material of the nut can be hardened steel and that of the kingpin bolt can also be hardened steel, but the material of the baseplate can be much softer aluminum. As used herein, the term "permanently affixed" means fixed in a manner that is not capable of being removed without destroying the shaft nut assembly or if removed, is not capable of reaffixing to the shaft nut assembly.

According to example aspects of the present disclosure, the kingpin can be variably tightened into the baseplate of a skateboard truck, which is provided by the novel orientation of the kingpin according to example aspects of the present disclosure. As the user tightens the kingpin bolt head (e.g., which may be accomplished with a common tool such as a screwdriver, nut wrench, etc.), the bolt head recedes toward the baseplate. The result of this tightening action is that the clearance between any obstacle on the ground and the end surface of the kingpin bolt head increases. As the elastomeric cushions may wear, compress, or if the user desires to increase the tension and turning of the truck hanger further, more clearance can be created and the possibility of impacting obstacles also reduced, thus also reducing potential falls.

Simply inverting or reversing the orientation of the steel bolt kingpin and a common nylon insert locknut presents obvious problems in subsequent kingpin wear resulting from contact between the hardened steel kingpin and the aluminum baseplate, especially from induced movement over time. Thus, another example aspect of the present disclosure relates to an improved nut shaft design (e.g., the shaft nut assembly) to prevent contact between the kingpin surface and the interior surface of the aluminum hole. The permanently affixed shaft nut assembly can provide a fixed hard steel surface located between the surface of the recess of the softer aluminum baseplate and the much harder surface of the hardened steel kingpin bolt.

While the truck is in use and the hanger is turning, force is applied by tilting action of the hanger, which is transmitted to the elastometic bushings and ultimately to the exposed shaft of the kingpin. This force moves the kingpin slightly, dozens or hundreds of times per hour, and if the hardened steel kingpin were to directly contact the softer surface of the baseplate aluminum (e.g., as in some known skateboard trucks), wear (e.g., from force deformation) occurs on the circular hole of the baseplate. Over time, wear can change the shape of the hole from a circle to an oval. Because the shape of the hardened steel kingpin cross section is circular, but a worn baseplate hole can become ovalized, the kingpin cannot be firmly affixed to the baseplate. In use, the kingpin can move significantly from side to side, affecting the turning of the truck and skateboard, and in turn, creating the potential for the user to lose control of the skateboard and fall.

Nut shafts (e.g., nut shaft assemblies, hex nut shaft, etc.) designed according to example aspects of the present disclosure can prevent contact between the harder kingpin and the softer baseplate. This can provide for the inverted orientation of the kingpin according to example aspects of the present disclosure. For instance, the shaft portion of the shaft nut assembly design can be assembled into the baseplate by a molding process (e.g., metal casting, in-situ molding, etc.) during manufacturing. Thus, aspects of the present disclosure provide for a controllable and adjustable ride in addition to having a design which recedes the kingpin end into the baseplate when tightening by the user, thus increasing safety. Skateboards according to example aspects of the present disclosure can additionally provide for improved durability and reduced likelihood of impact with road obstacles while the skateboard is in use.

In accordance with one or more particular aspects of the disclosed technology, an example skateboard truck can include both a kingpin and a threaded fastener, called a shaft nut, which when combined hold the two main components of a truck together to function properly. The two main components of a skateboard truck are the baseplate, which is mounted to the bottom surface of the skateboard deck; and the turning part of the truck called the hanger; which is mounted onto the baseplate by means of a metal bolt called a kingpin and affixed tightly into the baseplate by means of a threaded shaft nut that is permanently affixed within the baseplate. Two rubber or elastomeric material bushings placed along the shaft of the kingpin and on either side of a flange protruding from the hanger hold the hanger in place by the tightening of the kingpin into the threaded shaft nut fastener (e.g., shaft nut assembly, etc.).

According to an example aspect of the disclosed technology, the kingpin is configured in a specific orientation as it is mounted into the baseplate and held firm by the shaft nut assembly which is permanently affixed into the baseplate. The specific orientation of the kingpin is inverse to other skateboard trucks known in the art. For instance, the orientation of the kingpin is such that a threaded portion of the kingpin (on an end opposite a bolt portion) is generally facing towards a bottom surface of the skateboard deck as opposed to away from the bottom surface of the skateboard deck.

According to another example aspect of the disclosed technology, the disclosed skateboard truck is configured in a manner whereby the levels of tightness of the skateboard truck can be adjusted and as the truck becomes tighter, the head of the kingpin bolt lowers closer to the baseplate. More clearance distance between the kingpin bolt head and the ground is advantageous for the skateboard user so as to lessen the possibility of impacting any obstacle which one might roll over when using the skateboard. Impacting an obstacle will result in the user falling off the skateboard. The shaft nut embedded into the baseplate has an elongated steel sleeve which protrudes in the direction toward the kingpin bolt head. This unique design of nut and sleeve holds the kingpin shaft firmly and prevents movement or vibration during the use of the skateboard.

The skateboard truck technology described herein can help improve the integrity of overall skateboard structure, the efficacy of skateboard operation, and the safety of skateboard operators. By providing a skateboard truck configuration that allows for greater clearance distance between a kingpin component and the ground, a possibility of impact between the skateboard and obstacles in a travel path is reduced. This impact reduction means that skateboards can operate for longer durations between impact and/or that potential impact occurs with less severity. Both of these impact reduction scenarios can beneficially preserve the structure of the skateboard and its overall ability to continue in functional and effective operation. Additionally, the disclosed skateboard truck technology advantageously provides beneficial performance and safety measures to a skateboard operator. Impact reduction due to increased ground clearance can help to reduce the likelihood that a skateboard user will fall off the skateboard or potentially experience injury due to impact of the skateboard with an obstacle striking the kingpin.

One example aspect of the present disclosure is directed to a skateboard truck that includes a baseplate, a hanger, shaft nut assembly permanently affixed to the baseplate, and a kingpin bolt. The baseplate is configured for mounting to a bottom surface of a skateboard deck. The hanger is configured to hold an axle. The shaft nut assembly can be permanently affixed inside the baseplate. For example, the kingpin bolt can have a threaded portion affixed to the shaft nut assembly to secure the baseplate and the hanger together. In some embodiments the baseplate can include a first and second opposing primary surface. For example, the primary surface can be configured to be coincident with a bottom surface of the skateboard deck. The primary surface of the baseplate can include a recessed cavity. The shaft nut assembly can be permanently affixed within the recessed cavity.

In some example aspects of the present disclosure, a shaft portion is disposed between a first hex portion and a second hex portion. The first hex portion, the shaft portion, and the second hex portion can define a center hole.

In some example aspects of the present disclosure, an inside surface of the center hole can include cut threads. In addition, or alternatively, an outer surface of the shaft nut assembly can have a smooth circular diameter with no threads.

In some example aspects of the present disclosure, the inside surface of the center hole can include a threaded end opposed to a hollow end with a smooth circular diameter with no threads.

In some example aspects of the present disclosure, the shaft nut assembly is cast formed into the baseplate.

In some example aspects of the present disclosure, the outer surface of the shaft nut assembly can include a first hex portion protruding radially in a direction generally perpendicular to a first axis from the outer surface of the shaft portion to form an annular surface with a hex shaped outer edge and/or a second hex portion protruding radially in a direction generally perpendicular to the first axis from the outer surface of the shaft portion to form an annular surface with a hex shaped outer edge.

In some example aspects of the present disclosure, a first hex portion includes a first vertical surface and/or a second vertical surface that protrude radially from the outer surface of the shaft portion in a direction generally perpendicular to the first axis. In some example aspects of the present disclosure, the second hex portion further comprises a first vertical surface and/or a second vertical surface that protrude radially from the outer surface of the shaft portion in a direction generally perpendicular to the first axis.

In some example aspects of the present disclosure, a first hex portion can include a plurality of wall faces that are disposed between the first vertical surface and the second vertical surface that are positioned in a direction parallel to the first axis. In some example aspects of the present disclosure, the hex wall faces connect to form an outer edge of the annular surface, wherein the outer edge of the annular surface is hex shaped. For example, the second hex portion further comprises a plurality of wall faces that are disposed between the first vertical surface and the second vertical surface that are positioned in a direction parallel to the first axis. In some embodiments, the hex wall faces connect to form the outer edge of the annular surface. For example, the outer edge of the annular surface can be hex shaped.

In some example aspects of the present disclosure, the first and second vertical wall surfaces are configured to prevent linear movement parallel to the first axis.

In some example aspects of the present disclosure, the plurality of wall faces of the first hex portion and the plurality of wall faces of the second hex portion are configured to prevent rotational movement about the first axis.

In some example aspects of the present disclosure, the shaft nut assembly can include a first hex shaped nut. The first hex shaped nut can include a nylon insert. An inner surface of the first hex shaped nut can include threading. Additionally, or alternatively, the shaft nut assembly, can include an elongated hollow shaft portion. Additionally, or alternatively, the shaft nut assembly can include a second hex shaped nut. In some embodiments, the second hex shaped nut can be the same size as the first hex shaped nut. Additionally, or alternatively, an inner surface of the second hex shaped nut can include a smooth surface. The first hex shaped nut can be affixed to the elongated hollow shaft portion at a first end of the elongated hollow shaft portion. The second hexed shaped nut can be affixed to the elongated hollow shaft portion at a second end of the elongated hollow shaft portion. A through hole is formed through the entirety of the shaft nut assembly.

In some example aspects of the present disclosure, the kingpin bolt is configured operable to move to be tightened into the baseplate.

In some example aspects of the present disclosure, the kingpin bolt can include a first end comprising a threaded portion and a second end including a bolt head.

In some example aspects of the present disclosure, the baseplate is made of aluminum.

In some example aspects of the present disclosure, the baseplate is formed in the shape of one of a rectangle, oval, and/or square.

In some example aspects of the present disclosure, the hanger includes an aluminum hanger configured to hold a steel axle.

In some example aspects of the present disclosure, a skateboard including a skateboard deck and of the any embodiments of a skateboard truck disclosed herein.

An example aspect of the present disclosure is directed to a method for producing a skateboard truck. In some embodiments the method can include receiving a baseplate comprising a recess cavity. The method can include placing a shaft nut assembly within the recess cavity oriented in a manner to receive a threaded end of a kingpin bold. The method can include casting molten aluminum around the shaft nut assembly. The molten aluminum can be disposed between an outer surface of the shaft nut assembly and an inner surface of the recess cavity within the baseplate.

In some example aspects of the present disclosure, the method includes applying pressure through gravity casting.

In some example aspects of the present disclosure, the method includes applying pressure through die casting.

Reference now will be made in detail to embodiments, one or more example(s) of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

With reference now to the FIGS., example implementations of the present disclosure will be discussed in further detail.

Figure 1B:
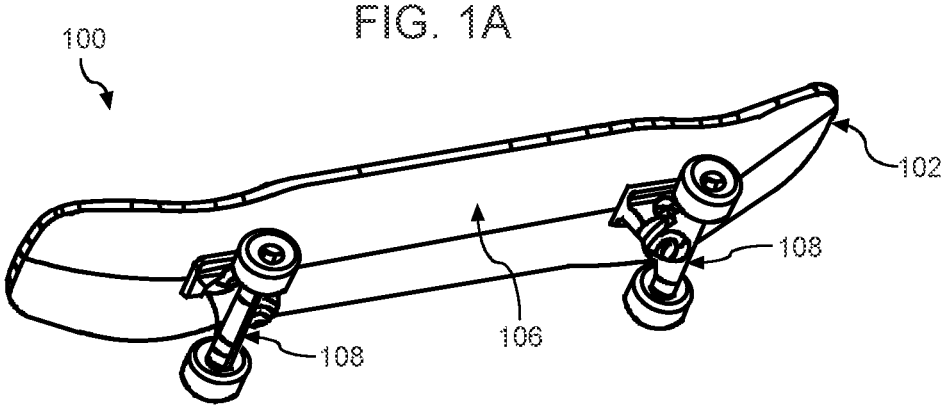
FIG. 1B provides a bottom perspective view of a skateboard according to example embodiments of the present disclosure.
Figure 1C:
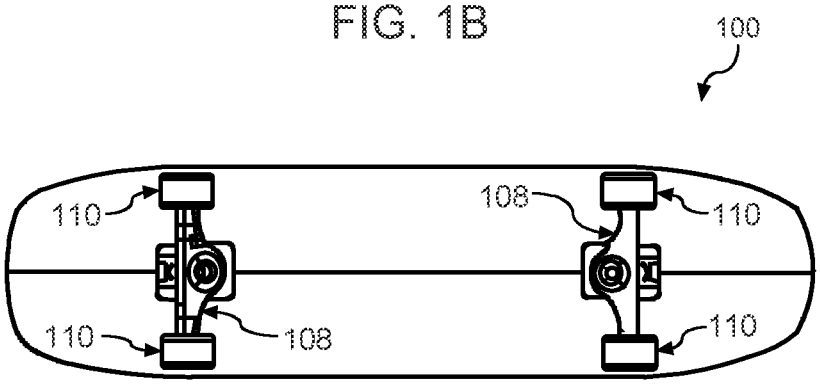
FIG. 1C provides a bottom plan view of a skateboard according to example embodiments of the present disclosure.
Figure 1D:
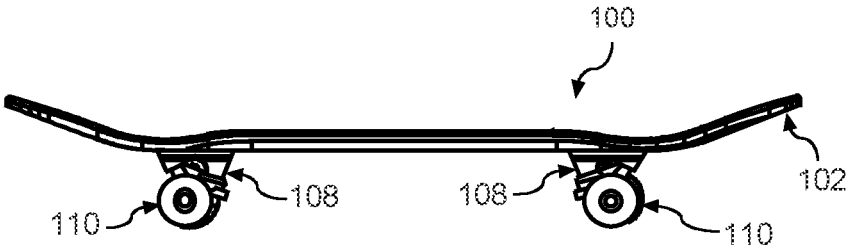
FIG. 1D provides a side plan view of a skateboard according to example embodiments of the present disclosure.

FIGS. 1A-1D collectively provide four profile views of a skateboard according to example embodiments of the present disclosure. More particularly, FIG. 1A provides a top perspective view of an example conventional skateboard 100, while FIG. 1B provides a bottom perspective view of skateboard 100, FIG. 1C provides a bottom plan view of skateboard 100, and FIG. 1D provides a side plan view of skateboard 100. Skateboard 100 includes a skateboard deck 102 formed as an elongated platform that has two opposing surfaces, namely a top surface 104 and a bottom surface 106. The top surface 104 of skateboard deck 102 corresponds to a surface upon which a skateboard user stands. The bottom surface 106 of skateboard deck 102 corresponds to a surface upon which two skateboard trucks 108 are mounted using, for example, machine screws or bolts. Wheels 110 and assembled bearings inside the wheels can be mounted to the truck axles. In one example, each skateboard truck 108 can have two wheels 110 and four bearings.

Figure 2:
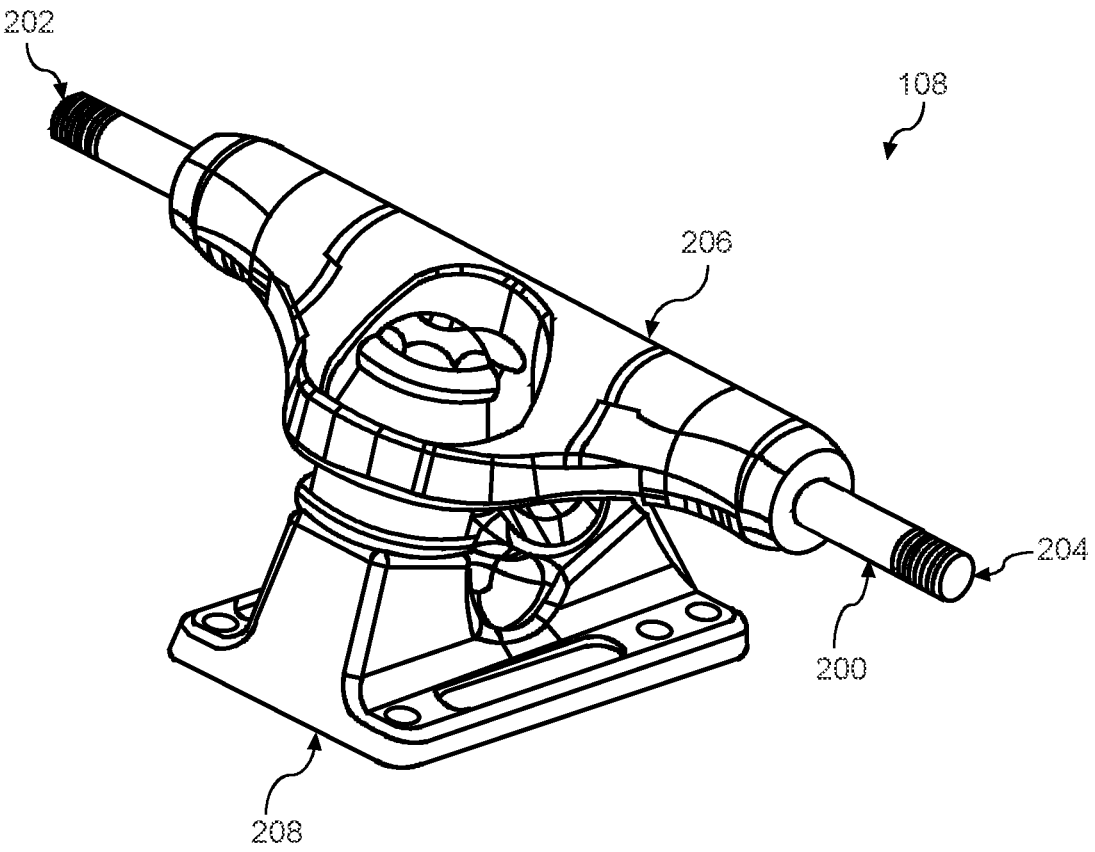
FIG. 2 provides an isometric view of a completely assembled skateboard truck according to example aspects of the present disclosure.

FIG. 2 provides an isometric view of a completely assembled skateboard truck 108 according to example aspects of the present disclosure. More particularly, the skateboard truck 108 of FIG. 2 includes an axle 200, a hanger 206, and a baseplate 208. Axle 200 can be characterized by a first end 202 and second end 204 opposing the axle first end 202. Hanger 206 can be configured to hold axle 200, for example, in a manner such that a major axis of the axle 200 is coincident to a major axis of the hanger 206. FIG. 2 depicts an orientation of the axle 200 inside the hanger 206. The axle 200 can include two axle ends, namely first end 202 and second end 204, each axle end configured to extend beyond surfaces of the hanger 206. The first end 202 and second end 204 of axle 200 can also have threads cut into each axle end such that they, are configured for bearings and wheels (e.g., wheels 110) to be affixed thereto. In some embodiments, the axle 200 can be formed of steel or other suitable material. The baseplate 208 can be configured for mounting to a bottom surface of a skateboard deck (e.g., bottom surface 106 of skateboard deck 102).

Figure 3:
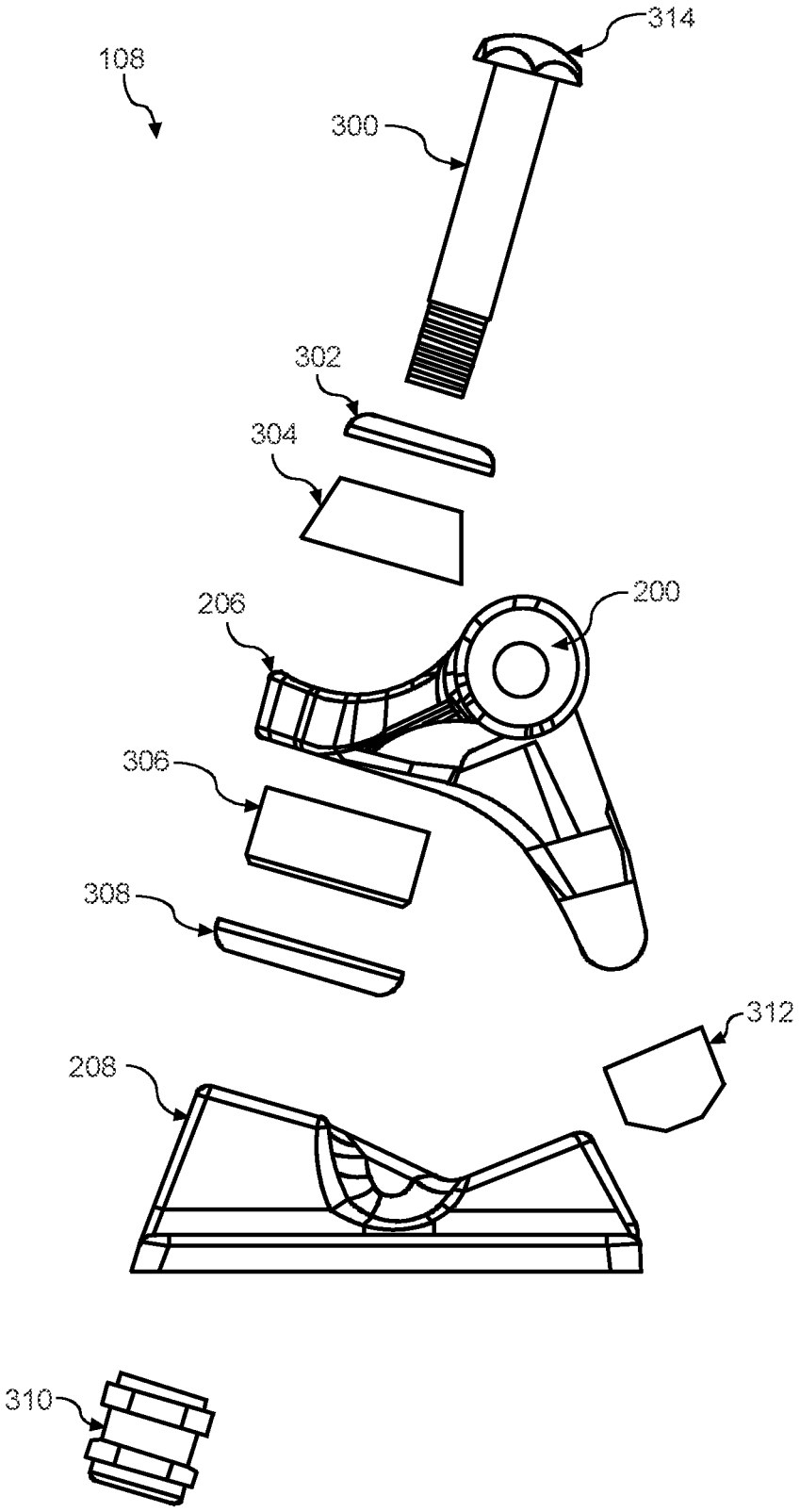
FIG. 3 provides an exploded side view of a skateboard truck according to example aspects of the present disclosure.
Figure 4:
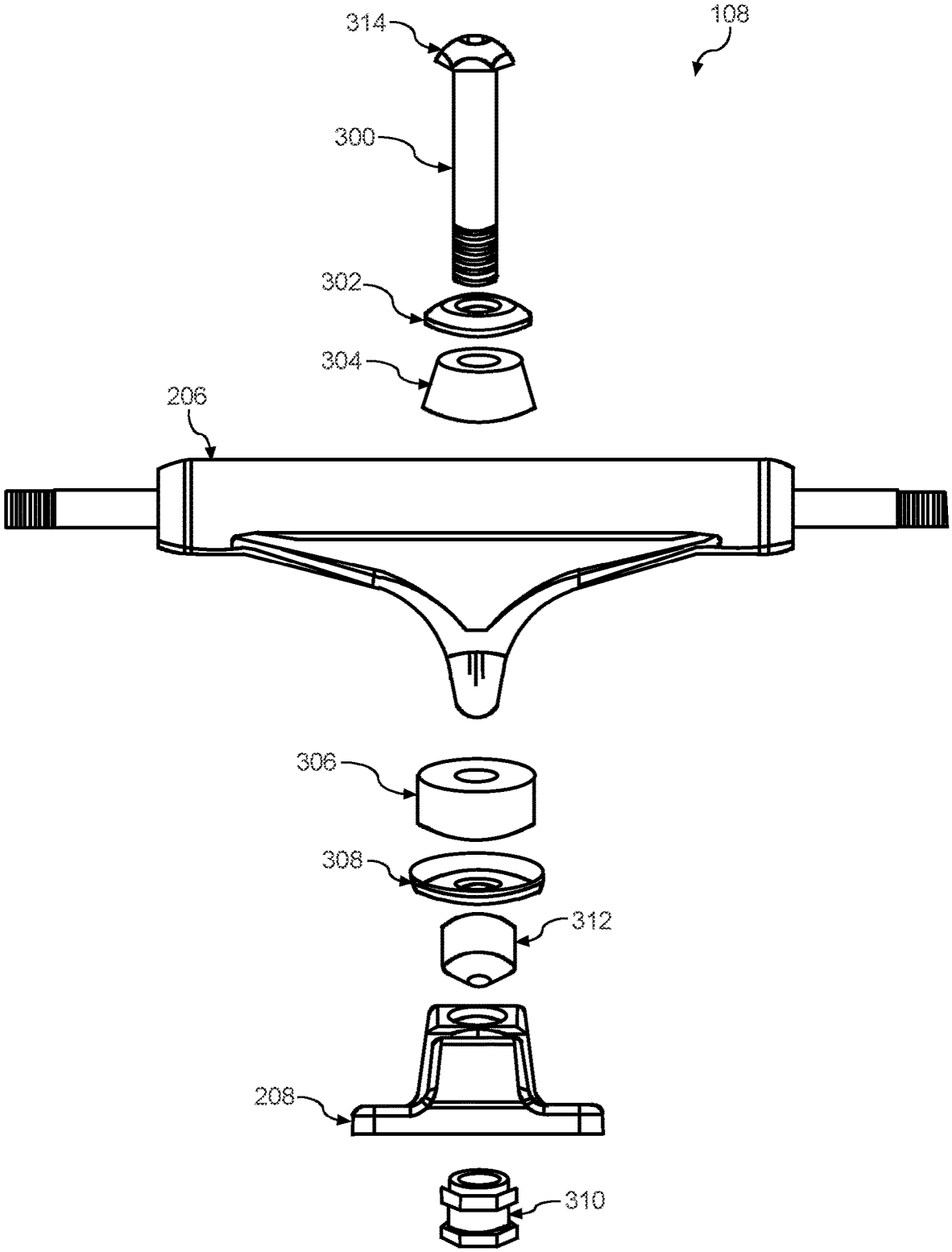
FIG. 4 provides an exploded front view of a skateboard truck according to according to example aspects of the present disclosure.

FIGS. 3 and 4 provide respective exploded views of a skateboard truck 108 according to example aspects of the present disclosure. FIG. 3 provides an exploded side view of skateboard truck 108, while FIG. 4 provides an exploded front view. More particularly, skateboard truck 108 can include a kingpin bolt 300, a first washer 302, a first bushing 304, hanger 206, a second bushing 306, a second washer 308, baseplate 208, a shaft nut assembly 310, and a pivot cup 312. Skateboard truck 108 notably can include the inverted kingpin bolt 300 with bolt head 314 outside of the baseplate 208 and the shaft nut assembly 310 permanently affixed within the baseplate 208. The suspension components of the skateboard truck 108 include the first washer 302 the first bushing 304, the hanger 206, the second bushing 306, the second washer 308, and the baseplate 208. The hanger 206 can include a mounting flange with a through hole at the center of the flange. The hanger 206 can have a special pivot point in the design, which can be surrounded by a pivot cup 312. The first bushing 304 and second bushing 306 can be placed along the shaft of the kingpin bolt 300 and on either side of the mounting flange protruding from the hanger 206 to hold the hanger 206 in place relative to baseplate 208 by the tightening of the kingpin bolt 300 into a threaded shaft nut fastener embodied by shaft nut assembly 310. In some example embodiments, the first washer 302 and/or the second washer 308 can be made of steel or other suitable material. In some example embodiments, the first bushing 304 and/or second bushing 306 can be made of rubber or an elastomeric material, such as but not limited to an elastomer plastic, or other suitable material. In some example embodiments, pivot cup 312 can be made of an elastomeric material, such as but not limited to elastomer plastic, or other suitable material.

Figure 5:
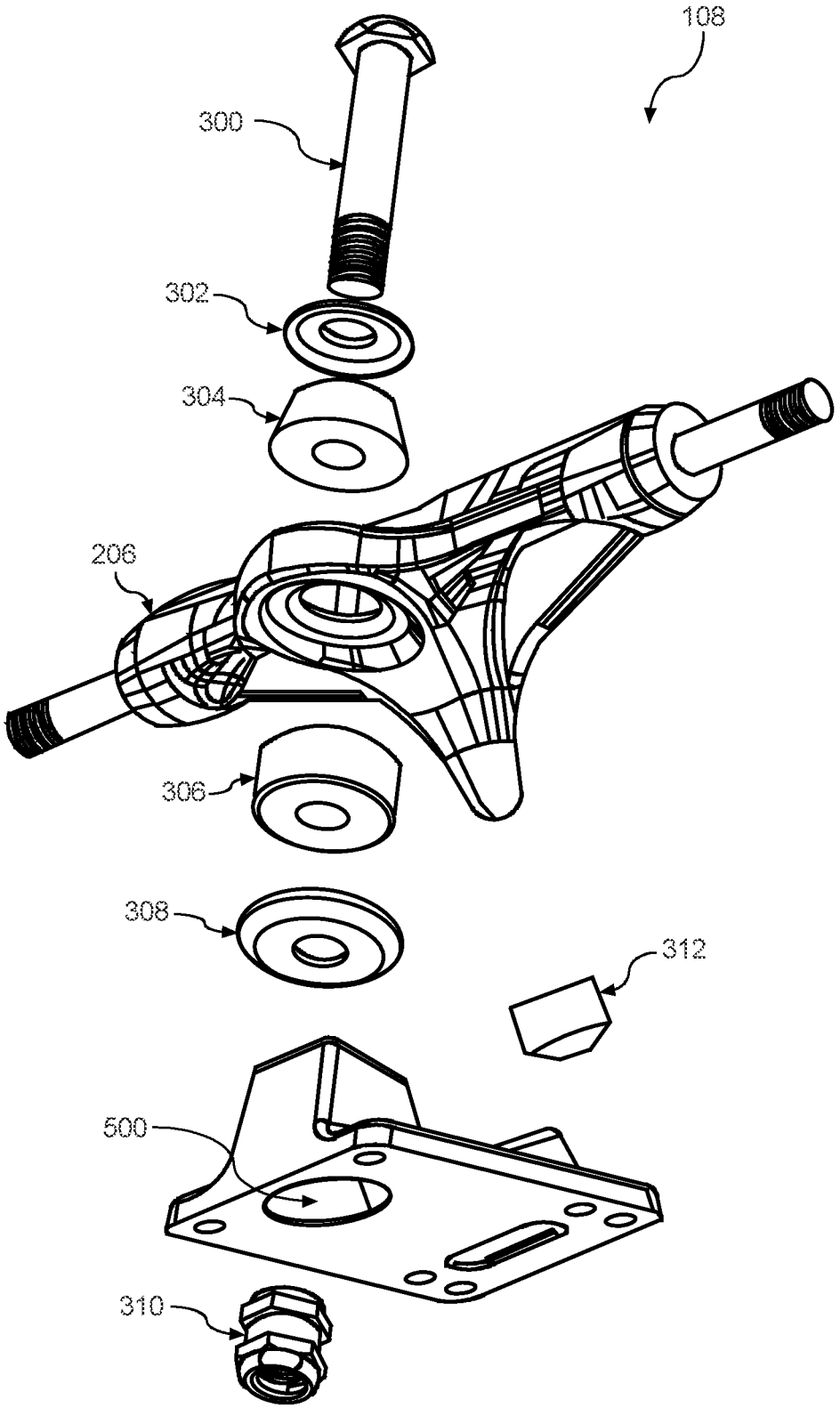
FIG. 5 provides an exploded view of a skateboard truck baseplate according to example aspects of the present disclosure.

FIG. 5 provides another exploded view of skateboard truck 108, particularly depicting example aspects of baseplate 208. FIG. 5 also depicts kingpin bolt 300 and its orientation to the shaft nut assembly 310, both on either side of the truck baseplate 208. In some examples, baseplate 208 can be made of aluminum or other suitable material. Additional aspects of baseplate 208 are depicted, for example, in FIGS. 10A-10C, FIGS. 11A-11B, and FIGS. 12A-12B.

Figure 6A:
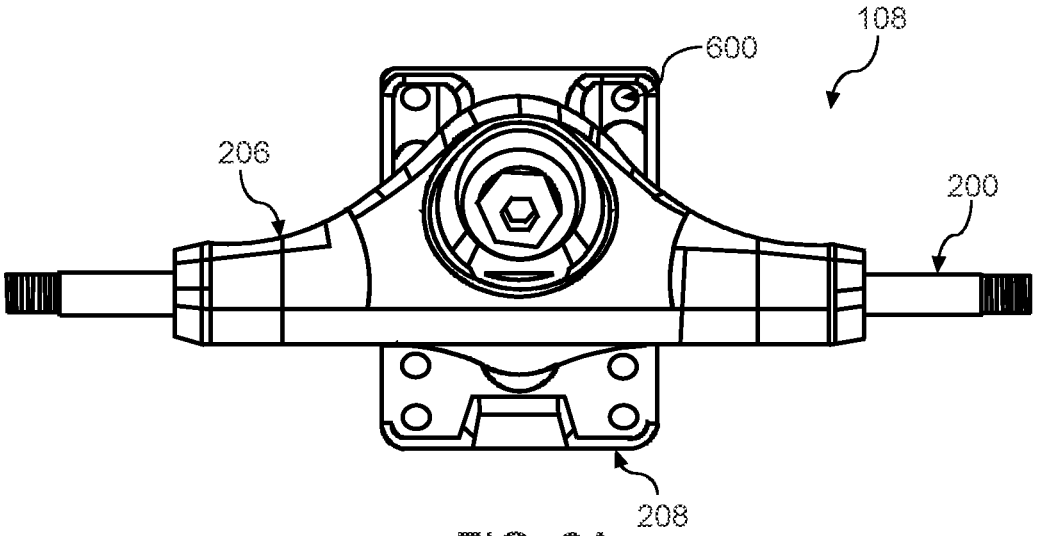
FIG. 6A provides a top view of an assembled skateboard truck according to example aspects of the present disclosure.
Figure 6B:
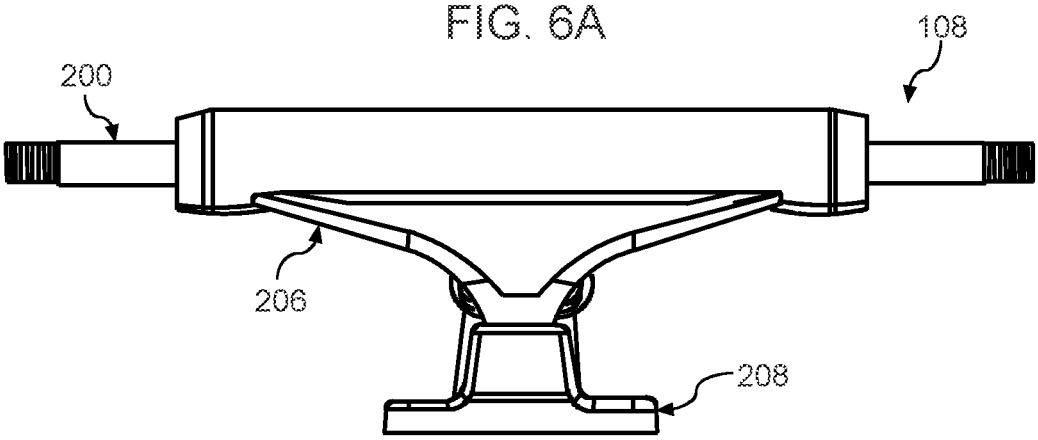
FIG. 6B provides a front view of an assembled skateboard truck according to example aspects of the present disclosure.
Figure 6C:
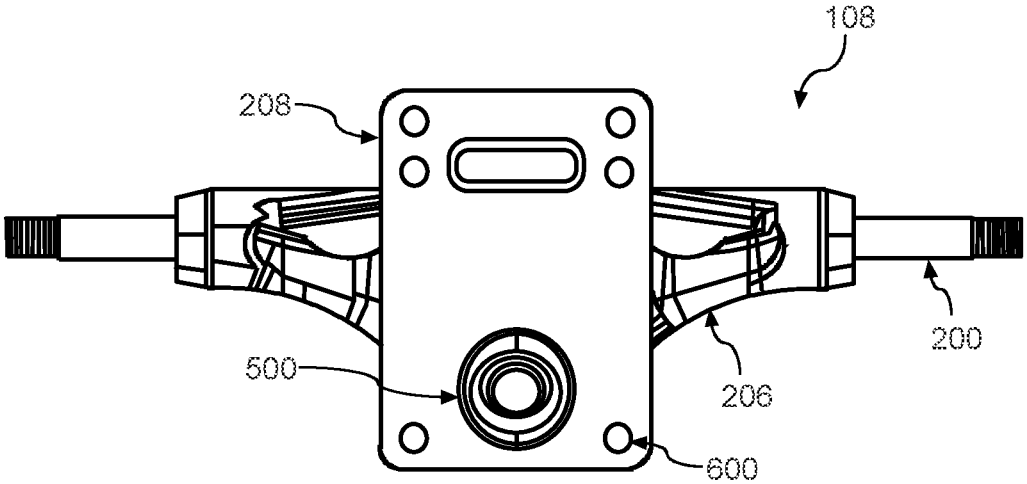
FIG. 6C provides a bottom view of an assembled skateboard truck according to example aspects of the present disclosure.

FIGS. 6A-6C provide respective assembled views of a skateboard truck 108 according to example aspects of the present disclosure. FIG. 6A provides a top view of assembled skateboard truck 108, FIG. 6B provides a front view of assembled skateboard truck 108, and FIG. 6C provides a bottom view of assembled skateboard truck 108. Skateboard truck 108 includes hanger 206 and baseplate 208. Hanger 206 is configured to hold axle 200 as illustrated. Baseplate 208 can include a plurality of mounting through holes 600. In some examples, as illustrated in FIGS. 6A-6C, baseplate 208 is generally rectangular in shape and includes four mounting through holes 600, one in each corner of the generally rectangular baseplate 208. It should be appreciated that the baseplate 208 could also be formed in different shapes, such as but not limited to a square shape, a circular shape, or an oval shape. In addition, the number and placement of the mounting through holes 600 can vary in accordance with different skateboard truck embodiments. For example, a baseplate 208 can include two, three, four, five, six, seven, eight or other number of mounting through holes 600. A skateboard truck 108 can be mounted to a skateboard deck (e.g., skateboard deck 102 as illustrated in FIGS. 1A-1D) by way of machine screws or bolts and nuts secured at the mounting through holes 600.

Figure 7A:
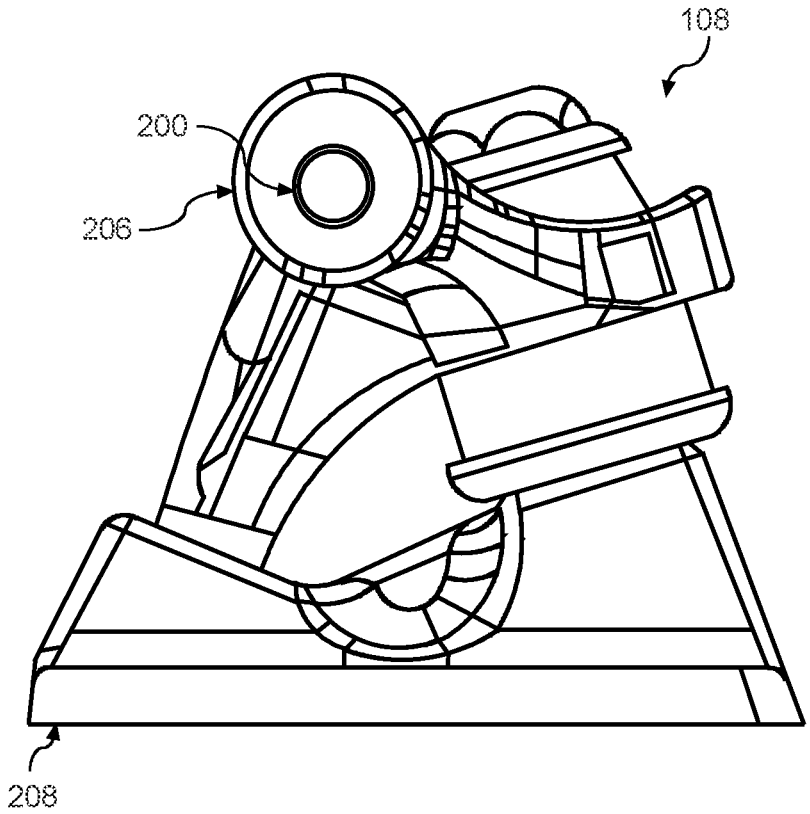
FIG. 7A provides a side full view of an assembled skateboard truck according to example aspects of the present disclosure.
Figure 7B:
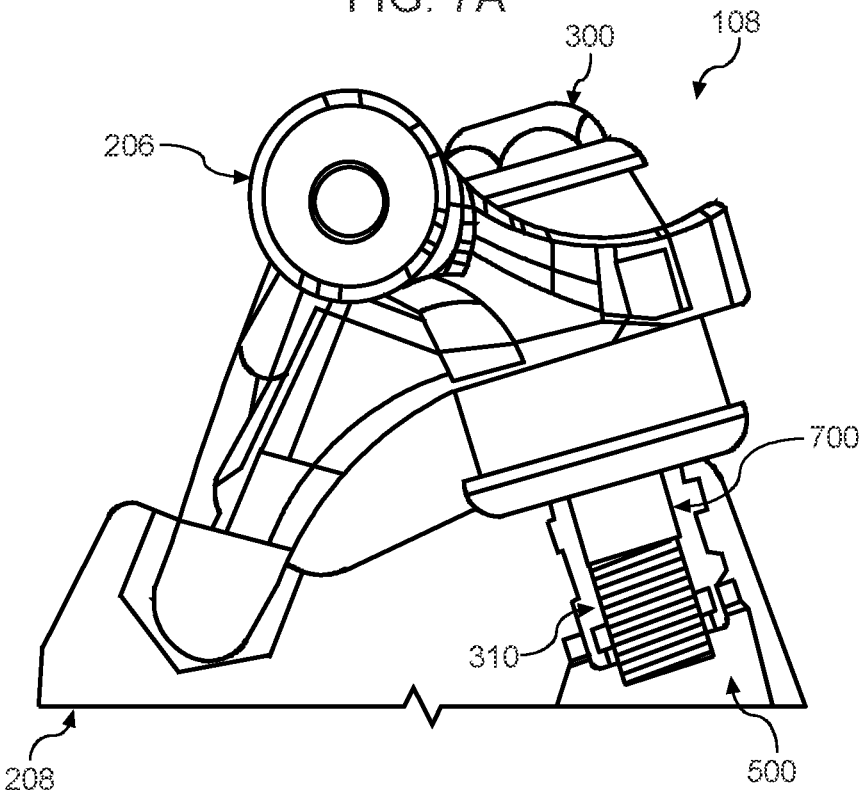
FIG. 7B provides a side cross-sectional view of an assembled skateboard truck according to example aspects of the present disclosure.

FIGS. 7A-7B depict respective side views of an assembled skateboard truck 108 according to example aspects of the present disclosure. FIG. 7A provides a side full view of skateboard truck 108, while FIG. 7B provides a side cross-sectional view of skateboard truck 108. FIG. 7A depicts hanger 206 with axle 200 assembled relative to baseplate 208 via kingpin bolt 300 and hex nut 310. As better illustrated in the cross-sectional view of FIG. 7B, the shaft nut assembly 310 is positioned with its shaft portion permanently affixed within the recess 500 of the baseplate 208. The shaft nut assembly 310 is formed to define a center hole 700 throughout, with threads, where the kingpin bolt 300 can slide though and engage the threads. Kingpin bolt 300 can be configured to be variably tightened into baseplate 208. The more kingpin bolt 300 is tightened, the more clearance is provided between skateboard truck 108 and a ground surface. The kingpin bolt 300 is configured for orientation relative to a skateboard deck such that a first end (corresponding to a threaded portion) generally faces the bottom surface of a skateboard deck (e.g., bottom surface 106 of skateboard deck 102).

Figure 8A:
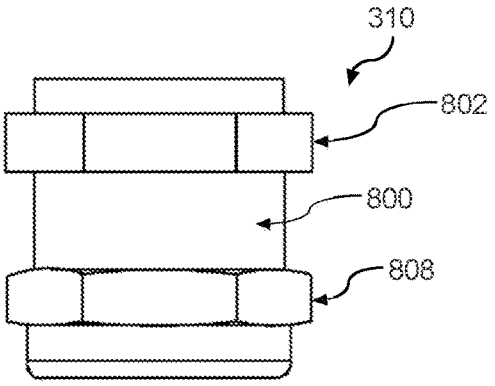
FIG. 8A provides a side full view of a shaft nut assembly according to example aspects of the present disclosure.
Figure 8B:
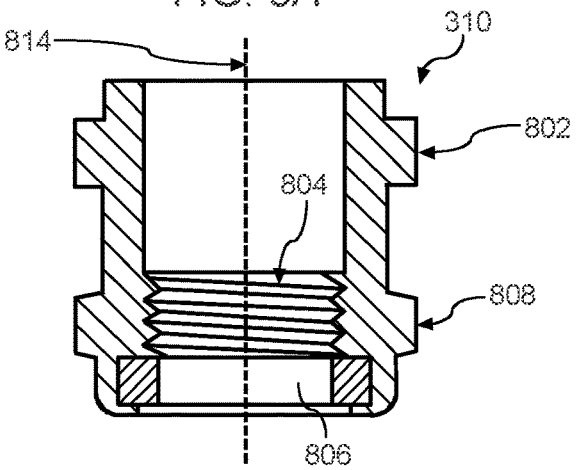
FIG. 8B provides a side cross-sectional view of a shaft nut assembly according to example aspects of the present disclosure.
Figure 8C:
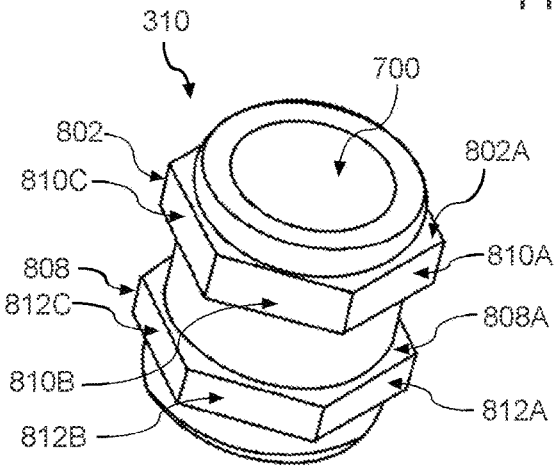
FIG. 8C provides an isometric view of a shaft nut assembly according to example aspects of the present disclosure.
Figure 8D:
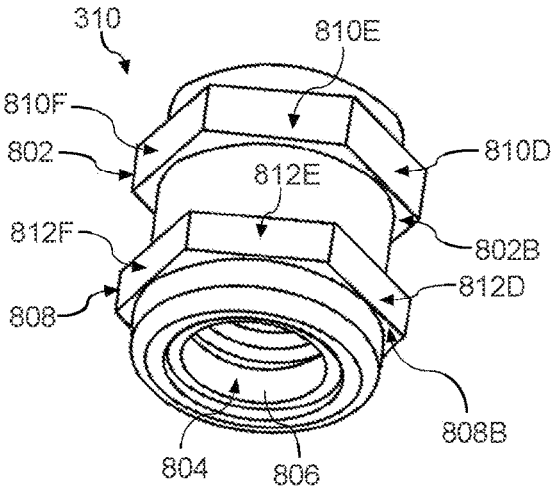
FIG. 8D provides an isometric view of a shaft nut assembly according to example aspects of the present disclosure.

FIGS. 8A-8D provide respective views of a shaft nut assembly 310 according to example aspects of the present disclosure. FIG. 8A depicts a side full view of shaft nut assembly 310, FIG. 8B depicts a side cross-sectional view of shaft nut assembly 310, FIG. 8C depicts a bottom perspective view of shaft nut assembly 310, and FIG. 8D depicts a top perspective view of shaft nut assembly 310.

Shaft nut assembly 310 can include a shaft portion 800, a first hex portion 808, and a second hex portion 802. The first hex portion 808 can be formed adjacent to shaft portion 800 on a first end of shaft 800. The shaft nut assembly 310 can include a nylon insert ring 806. The shaft nut assembly can also include threads 804 which are disposed on the inner surface of shaft 800. The second hex portion 802 can be formed adjacent to shaft portion 800 on a second end opposed to the first end of shaft 800. The first hex portion 808 and second hex portion 802 can protrude radially in a direction generally perpendicular (e.g., within 15-degrees of a 90-degree angle) to a first axis 814 that runs parallel to the outer surface and/or inner surface of the shaft 800. The first hex portion 808 can include a first vertical wall face 808A and a second vertical wall face 808B. The first vertical wall face 808A and the second vertical wall face 808B can protrude radially in a direction generally perpendicular to the first axis 814 from the outer surface of shaft 800. The first hex portion 808 can include a plurality of horizontal wall faces 812A-812E that can be disposed between the first vertical surface 808A and the second vertical surface 808B in a direction generally parallel to the first axis 814. The second hex portion 802 can be formed adjacent to the shaft portion 800 on a second end of shaft 800. The second hex portion can include a first vertical wall face 802A and a second vertical wall face 802B. The first vertical wall face 802A and the second vertical wall face 802B can protrude radially in a direction generally perpendicular to the first axis 814 from the outer surface of shaft 800. The second hex portion 802 can include a plurality of horizontal wall faces 810A-810F that can be disposed between the first vertical surface 802A and the second vertical surface 802B in a direction generally parallel to the first axis 814. The first hex portion 808, shaft 800, and second hex portion 800 can be formed to define a center hole 700 throughout. An inside surface of center hole 700 formed throughout the first hex portion 808, shaft portion 800, and second hex portion 802 can include cut threads. Cut threads 804 of the shaft nut assembly 310 can engage with a threaded portion of kingpin bolt 300.

The vertical wall faces 808A, 808B, 802A, and 802B can be configured to prevent linear movement in a direction parallel to the first axis 814. The plurality of horizontal wall faces 810A-810F and 812A-812F can be configured to prevent rotational movement about the first axis 814. While the first hex portion 808 and second hex portion 802 can be formed as a generally hexagonal shaped nut, it should be appreciated that other polygonal variations are also within the scope of the disclosed technology. Shaft portion 800 of the shaft nut assembly can be formed with a smooth circular outer diameter surface with no threads. The shaft nut assembly 310 can also include a special nylon insert ring 806 that helps facilitate engagement of the kingpin bolt 300 with the shaft nut assembly 310.

Figure 9A:
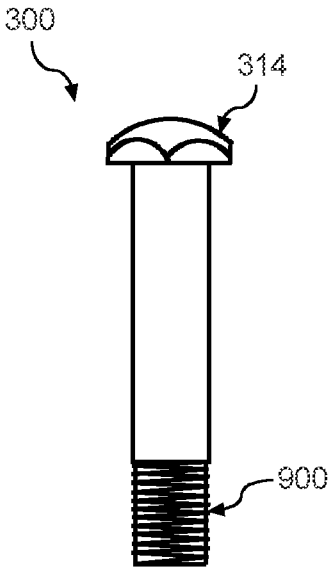
FIG. 9A provides a side full view of a kingpin bolt according to example aspects of the present disclosure.
Figure 9B:
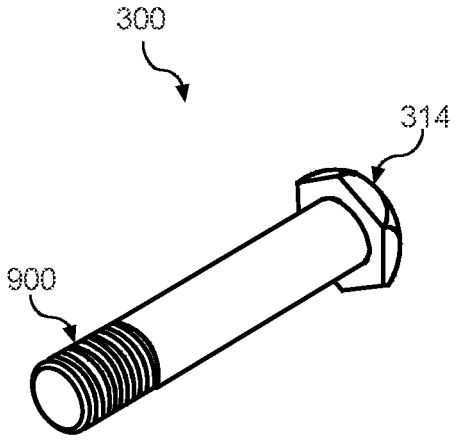
FIG. 9B provides a top perspective view of a kingpin bolt according to example aspects of the present disclosure.
Figure 9C:
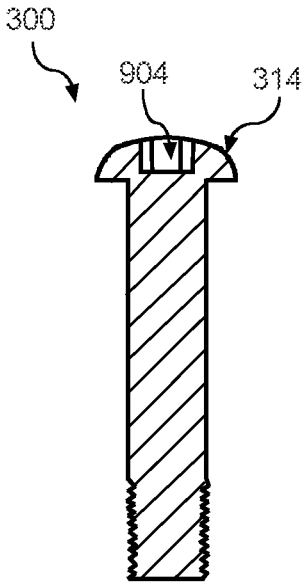
FIG. 9C provides a side cross-sectional view of a kingpin bolt according to example aspects of the present disclosure.
Figure 9D:
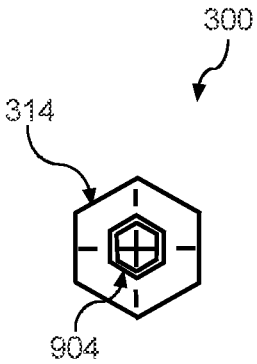
FIG. 9D provides a top view of a kingpin bolt according to example aspects of the present disclosure.

FIGS. 9A-D provide respective views of a kingpin bolt 300 according to example aspects of the present disclosure. FIG. 9A depicts a side full view of kingpin bolt 300, FIG. 9B depicts an isometric view of a kingpin bolt, FIG. 9C depicts a side cross-sectional view of kingpin bolt 300, and FIG. 9D depicts a top view of kingpin bolt 300. Kingpin bolt 300 can include first and second opposing ends, with the first end of the kingpin bolt 300 corresponding to a threaded portion 900 and a second end of the kingpin bolt 300 corresponding to bolt head portion 314. The threaded portion 900 of kingpin bolt 300 can engage and help affix the kingpin bolt 300 to a shaft nut assembly (e.g., shaft nut assembly 310) to secure a baseplate (e.g., baseplate 208) and hanger (e.g., hanger 206) together relative to a bottom surface of a skateboard deck (e.g., bottom surface 106 of skateboard deck 102). In some examples, the bolt head portion 314 can be configured in a polygonal shape, such as but not limited to a round shape or a hex shape. The kingpin bolt 300 can be turned with tools from the outside surface of the bolt head portion 314 (e.g., the hex shape), such as shown in the top view of FIG. 9D. Additionally, or alternatively, a hex wrench may also turn the kingpin bolt 300 by placing the hex wrench into the hex hole 904 in the top of the bolt head portion 314.

Figure 10A:
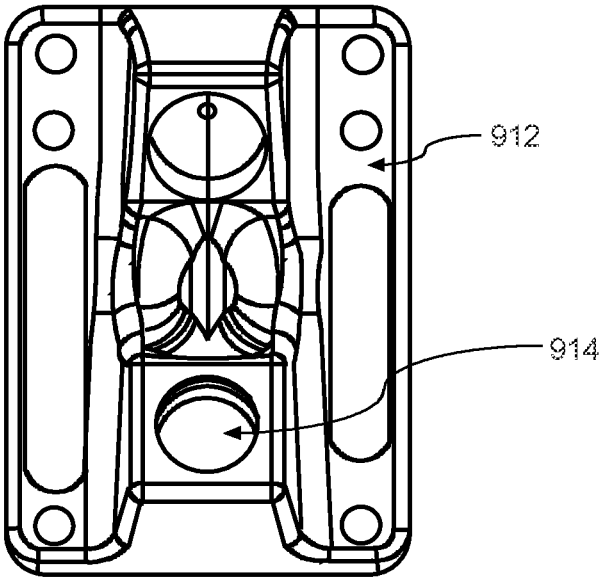
FIG. 10A provides a top view of a baseplate according to example aspects of the present disclosure.
Figure 10B:
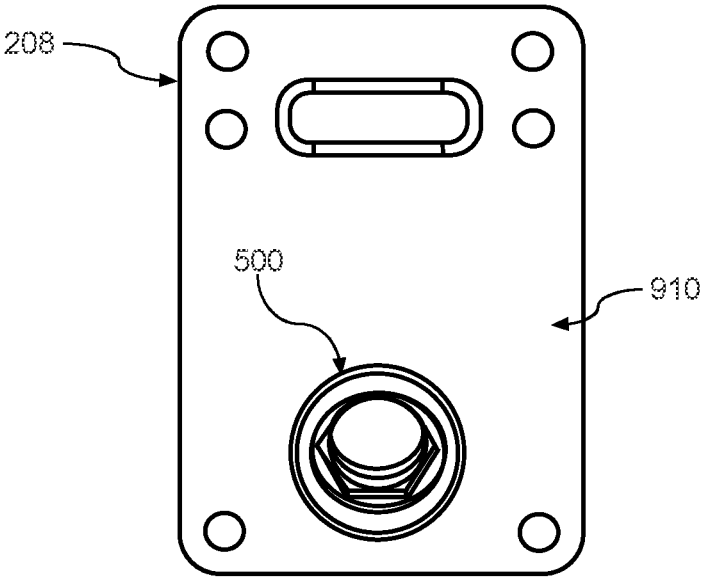
FIG. 10B provides a bottom view of a baseplate according to example aspects of the present disclosure.
Figure 10C:
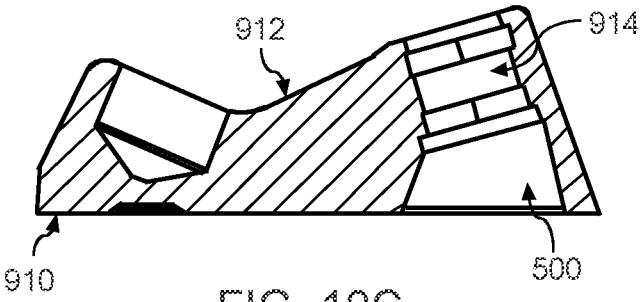
FIG. 10C provides a side cross-sectional view of a baseplate according to example aspects of the present disclosure.

FIGS. 10A-10C provide respective views of an example baseplate 208 according to example aspects of the present disclosure. FIG. 10A depicts a top view of baseplate 208, while FIG. 10B depicts a bottom view of a baseplate 208, and FIG. 10C depicts a side cross-sectional view of baseplate 208. Baseplate 208 can include first and second opposing primary surfaces, such as first primary surface 910 and second primary surface 912. The first primary surface 910 of baseplate 208 is configured to be positioned coincident with a bottom surface of a skateboard deck (e.g., bottom surface 106 of skateboard deck 102). The first primary surface 910 of baseplate 208 can include recess 500, corresponding to a recessed cavity within which the shaft nut assembly (e.g., shaft nut assembly 310) can be permanently affixed (e.g., through a molding process). The baseplate 208 can also include a molded cavity 914. The molded cavity 914 can include an opening through the recess 500 and out to the second primary surface 912 of baseplate 208. Molded cavity 914 can be configured to receive the shaft nut assembly (e.g., shaft nut assembly 310) permanently through a molding process. For example, the shaft nut assembly can be permanently affixed within the molded cavity 914 through a molding process (e.g., in-situ molding, etc.). The shaft nut assembly (e.g., shaft nut assembly 310) can be placed within molded cavity 914. Molten aluminum (e.g., liquid aluminum) can be cast into a closed baseplate mold and surround the shaft nut assembly that is placed (e.g., suspended) within the molded cavity 914. Molten aluminum can be placed between the outer surface of shaft nut assembly (e.g., shaft nut assembly 310) and inner surface of molded cavity 914. The molded cavity 914 can have the same inside dimension as an outer major surface of the shaft nut assembly (e.g., shaft nut assembly 310). This can permanently affix (e.g., bind) the shaft nut assembly (e.g., shaft nut assembly 310) within the molded cavity 914.

Figure 11A:
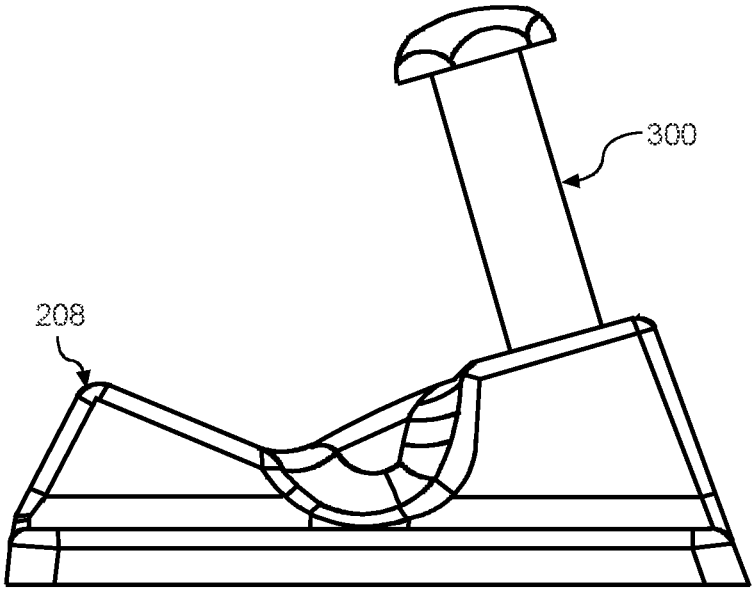
FIG. 11A provides a side full view of a baseplate showing kingpin bolt with the shaft nut assembly permanently affixed inside the baseplate according to example aspects of the present disclosure.
Figure 11B:
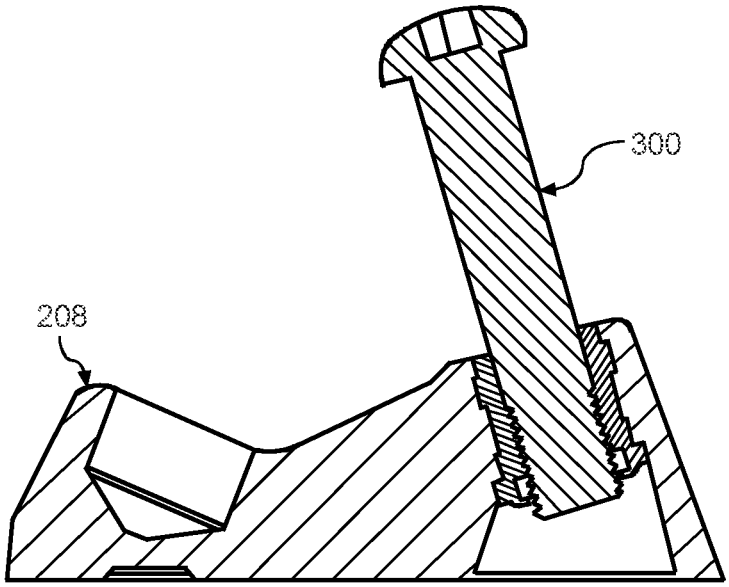
FIG. 11B provides a side cross-sectional view of a baseplate with kingpin bolt and a shaft nut assembly permanently affixed inside the baseplate according to example aspects of the present disclosure.

FIGS. 11A-11B provide respective views of an example baseplate 208 with kingpin bolt 300 and shaft nut assembly 310 installed according to example aspects of the present disclosure. FIG. 11A depicts a side full view of such assembly, while FIG. 11B depicts a side cross-sectional view of such assembly. In particular, FIG. 11A shows an orientation of the kingpin bolt 300 to the baseplate 208, while FIG. 11B shows the kingpin bolt 300 engaging the threads of a shaft nut assembly 310. The first hex portion (e.g., hex portion 808 as shown in FIG. 8) and second hex portion (e.g., hex portion 802 as shown in FIG. 8) of the shaft nut assembly 310 are permanently affixed within the baseplate recess 500. The shaft nut assembly 310 can be molded within the molded cavity 914.

Figure 12A:
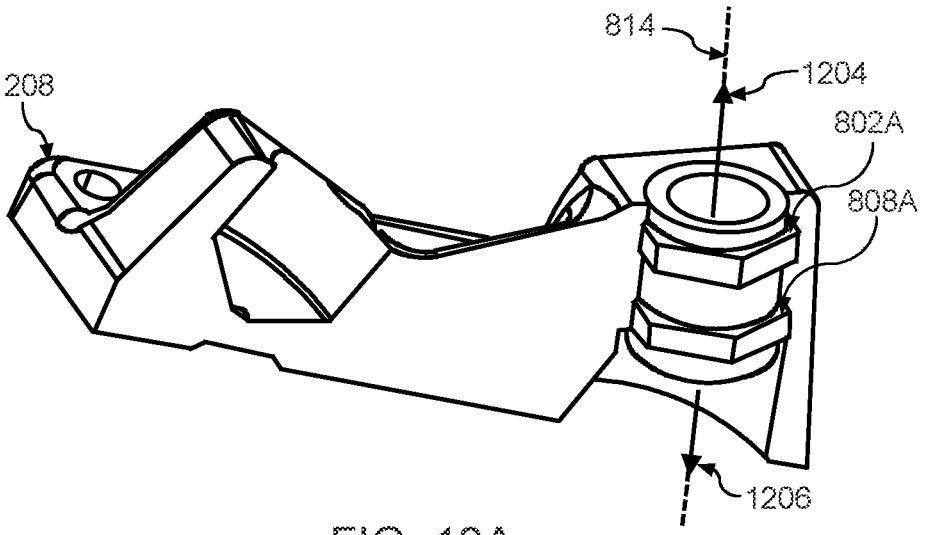
FIG. 12A provides a top perspective cross-sectional view of a baseplate with a shaft nut assembly permanently affixed inside the baseplate according to example aspects of the present disclosure.
Figure 12B:
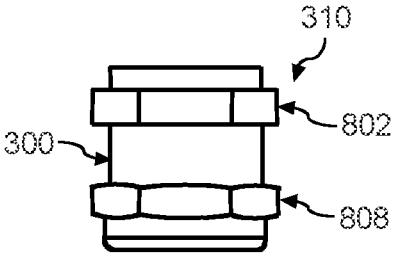
FIG. 12B provides a side view of the shaft nut assembly according to example aspects of the present disclosure.
Figure 12C:
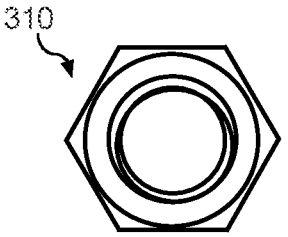
FIG. 12C provides a top view of the shaft nut assembly according to example aspects of the present disclosure.
Figure 12D:
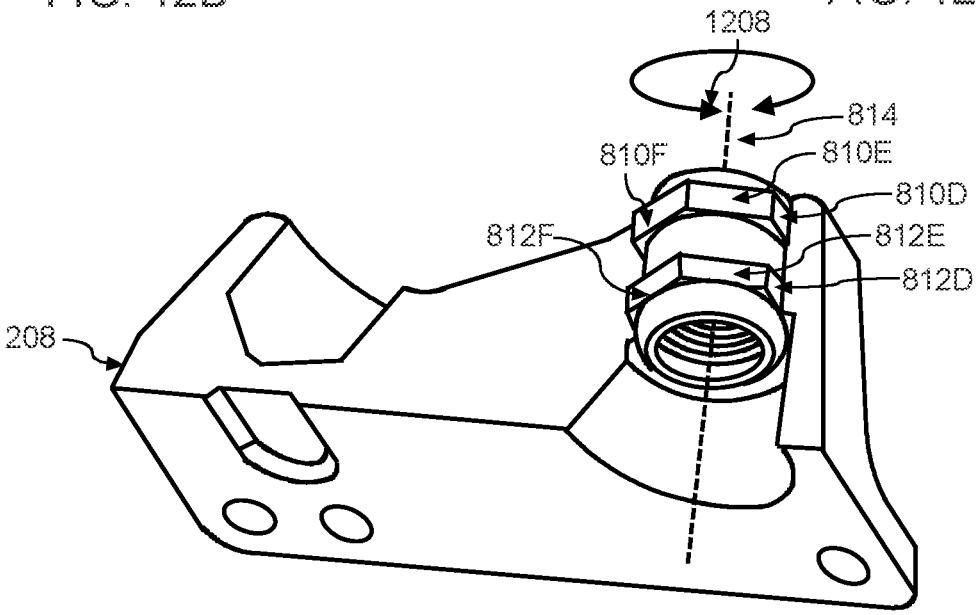
FIG. 12D provides a bottom perspective cross-sectional view of a baseplate with a shaft nut assembly permanently affixed inside the baseplate according to example aspects of the present disclosure.

FIGS. 12A-12D provide further views of baseplate 208 and shaft nut assembly 310. FIG. 12A depicts an isometric cross-sectional view of a baseplate with a shaft nut assembly 310 permanently affixed to the baseplate 208, FIG. 12B provides a side view of the shaft nut assembly 310, FIG. 12C provides a top view of the shaft nut assembly, FIG. 12D provides an isometric cross-sectional view of a baseplate 208 with a shaft nut assembly 310 permanently affixed to the baseplate 208. FIG. 12A depicts the shaft nut assembly 310 permanently affixed inside the baseplate 208. A first axis 814 can run generally parallel to the inner surface of shaft nut assembly 310, The arrows 1204 and 1206 depicted on the opposed ends of first axis 814 indicate a direction of linear movement along first axis 814. FIG. 12B provides a side view of shaft nut assembly as depicted in FIG. 8A. The shaft nut assembly 310 can include first hex portion 808, shaft 800, and second hex portion 802. FIG. 12C depicts a top view of shaft nut assembly 310. FIG. 12D depicts an additional cross-sectional view of baseplate 208. The arrows show a rotational axial movement direction 1208 around first axis 814. The plurality of wall faces (e.g., plurality of wall faces 810A-810F and 812A-812F) can be permanently affixed inside the baseplate. The plurality of wall faces can prevent movement in the rotational axial movement direction 1208.

While the present subject matter has been described in detail with respect to various specific example embodiments thereof, each example is provided by way of explanation, not limitation of the disclosure. Those skilled in the art, upon attaining an understanding of the foregoing, can readily produce alterations to, variations of, and/or equivalents to such embodiments. Accordingly, the subject disclosure does not preclude inclusion of such modifications, variations, and/or additions to the present subject matter as would be readily apparent to one of ordinary skill in the art. For instance, features illustrated and/or described as part of one embodiment can be used with another embodiment to yield a still further embodiment. Thus, it is intended that the present disclosure cover such alterations, variations, and/or equivalents.

What is claimed is:

1. A skateboard truck, comprising:

a baseplate configured for mounting to a bottom surface of a skateboard deck, wherein the baseplate comprises: (i) a recessed cavity and (ii) a shaft nut assembly permanently affixed within the recessed cavity, wherein the shaft nut assembly is cast formed into the baseplate;

a hanger configured to hold an axle; and a kingpin bolt having a threaded portion affixed to the shaft nut assembly to secure the baseplate and hanger together.

2. The skateboard truck of claim 1, wherein the baseplate comprises a first and second opposing primary surfaces, the first primary surface configured to be positioned coincident with a bottom surface of a skateboard deck.

3. The skateboard truck of claim 1, wherein the shaft nut assembly comprises a shaft portion disposed between a first hex portion and a second hex portion, wherein the first hex portion, the shaft portion, and the second hex portion define a center hole.

4. The skateboard truck of claim 3, wherein:

an inside surface of the center hole comprises cut threads; and an outer surface of the shaft nut assembly has a smooth circular diameter with no threads.

5. The skateboard truck of claim 4, wherein the inside surface of the center hole further comprises a threaded end opposed to a hollow end with a smooth circular diameter with no threads.

6. The skateboard truck of claim 4, wherein the outer surface of the shaft nut assembly further comprises:

the first hex portion protruding radially in a direction perpendicular to a first axis from the outer surface of the shaft portion to form an annular surface with a hex shaped outer edge; and the second hex portion protruding radially in a direction perpendicular to the first axis from the outer surface of the shaft portion to form an annular surface with a hex shaped outer edge.

7. The skateboard truck of claim 6, wherein the first hex portion further comprises a first vertical surface and a second vertical surface that protrude radially from the outer surface of the shaft portion in a direction generally perpendicular to the first axis, and wherein the second hex portion further comprises a first vertical surface and a second vertical surface that protrude radially from the outer surface of the shaft portion in a direction generally perpendicular to the first axis.

8. The skateboard truck of claim 7, wherein the first hex portion further comprises a plurality of wall faces that are disposed between the first vertical surface and the second vertical surface that are positioned in a direction parallel to the first axis, wherein the wall faces connect to form an outer edge of the annular surface, wherein the outer edge of the annular surface is hex shaped, and wherein the second hex portion further comprises a plurality of wall faces that are disposed between the first vertical surface and the second vertical surface that are positioned in a direction parallel to the first axis, wherein the wall faces connect to form the outer edge of the annular surface, wherein the outer edge of the annular surface is hex shaped.

9. The skateboard truck of claim 7, wherein the first and second vertical surfaces are configured to prevent linear movement parallel to the first axis.

10. The skateboard truck of claim 8, wherein the plurality of wall faces of the first hex portion and the plurality of wall faces of the second hex portion are configured to prevent rotational movement about the first axis.

11. The skateboard truck of claim 1, wherein the shaft nut assembly comprises:

a first hex shaped nut, wherein the first hex shaped nut comprises a nylon insert, wherein an inner surface of the first hex shaped nut comprises threading;

an elongated hollow shaft portion;

a second hex shaped nut, wherein the second hex shaped nut is the same size as the first hex shaped nut;

wherein an inner surface of the first hex shaped nut comprises a smooth surface;

wherein the first hex shaped nut is affixed to the elongated hollow shaft portion at a first end of the elongated hollow shaft portion;

wherein the second hexed shaped nut is affixed to the elongated hollow shaft portion at a second end of the elongated hollow shaft portion; and wherein a through hole is formed through the entirety of the shaft nut assembly.

12. The skateboard truck of claim 1, wherein the kingpin bolt is configured operable to move to be tightened into the baseplate.

13. The skateboard truck of claim 1, wherein the kingpin bolt further comprises a first end comprising the threaded portion and a second end comprising a bolt head.

14. The skateboard truck of claim 1, wherein the baseplate is made of aluminum.

15. The skateboard truck of claim 1, wherein the baseplate is formed in the shape of one of a rectangle, oval, or square.

16. The skateboard truck of claim 1, wherein the hanger comprises an aluminum hanger configured to hold a steel axle.

17. A skateboard comprising:

a skateboard deck; and the skateboard truck of claim 1.

* * * * *